United States Patent [19]

Pré et al.

[11] Patent Number: 4,967,921

[45] Date of Patent: Nov. 6, 1990

[54] CONTAINER WITH CLOSURE

[75] Inventors: Gérard Pré, La Tour-De-Peilz; Yvo Sturny, Vevey, both of Switzerland

[73] Assignee: Nestec S. A., Vevey, Switzerland

[21] Appl. No.: 381,481

[22] Filed: Jul. 18, 1989

[30] Foreign Application Priority Data

Jul. 22, 1988 [CH] Switzerland ..... 2822/88

[51] Int. Cl.[5] ..... B65D 41/02

[52] U.S. Cl. ..... 215/295

[58] Field of Search ..... 215/295, 329

[56] References Cited

U.S. PATENT DOCUMENTS 3,826,397 7/1974 Atkins ..... 215/295

3,904,063 9/1975 Hauser ..... 215/318

FOREIGN PATENT DOCUMENTS 613907 1/1977 Switzerland .

2063226 6/1981 United Kingdom .

*Primary Examiner*—Donald F. Norton

*Attorney, Agent, or Firm*—Vogt & O'Donnell

[57] ABSTRACT

A container having a base connected to sidewalls which extend to a neck which is substantially elliptical in shape which is surmounted by a rim which forms a substantially elliptical shape, wherein the neck and rim define a container opening which is substantially elliptical in shape, has a closure which locks to the rim for closing the opening. The closure which encompasses the opening and rim, has a base which is substantially rectangular in shape from which a deformable skirt, which forms sides of the closure, extends. Fastening means extend from a surface of each skirt closure side adjacent the rim and neck for engaging the rim for locking the closure to the rim such that upon rotation of the closure relative to the container, the fastening means extending from the skirt closure sides extending along the width of the base are disengaged from the rim while the fastening means extending from the skirt closure sides extending along the length of the base are disengaged by means of deformation of the skirt against the edge of the rim and neck of the container.

11 Claims, 2 Drawing Sheets

CONTAINER WITH CLOSURE

BACKGROUND OF THE INVENTION

This invention relates to a container and closure, the container comprising a neck surmounted by a rim which forms the opening of the container and the closure comprising a relatively flexible skirt provided internally with fastening means for attachment to the rim.

CH-PS 565 682 already describes a container and closure. In this system, unlocking of the closure involves the application of a relatively high rotational force and the deformation of the skirt at four places, the skirt additionally comprising internal bosses to facilitate its deformation.

GB-PS 2,063,226 also describes a container and closure in which the neck of the container comprises projecting parts uniformly distributed around its periphery cooperating with hooks on the inside of the skirt of the closure for locking the closure. In this system, as in the Swiss patent cited above, the opening of the container is circular which makes access to the product fairly difficult.

SUMMARY OF THE INVENTION

The object of the present invention is to provide a safe opening system which is simpler to unlock, easy to handle, does not require the application of excessive forces to the closure and provides easy access to the packed product.

The present invention relates to a container and closure in which the rim and the neck are substantially elliptical in shape and the closure is substantially rectangular in shape so that it can cap the elliptical opening, the rotation of the closure relative to the container enabling the two fastenings on the width side of the skirt of the closure to be disengaged from the rim and the two fastenings on the length side of the skirt of the closure to be unlocked by deformation of the skirt against the substantially elliptical rim and neck at the level of their minor axis.

The neck follows the contour of the rim forming the opening of the container and also has a substantially elliptical configuration. By virtue of this configuration, the skirt is only deformed at two places when the closure is unlocked.

The container according to the invention may be used to pack any granular or powder-form product, particularly instant coffee. The container is preferably made of glass or an equivalent material while the closure is made of a deformable plastic material, such as polypropylene, polyethylene, etc.

Unlocking is further facilitated if the rim of the container forms an angle of 60° to 75° with the base of the container. This is because, when the fastening tabs are unlocked, they slide on the rim and the return of the skirt to its normal position thus imparts a kind of acceleration to the closure which is thus disengaged very easily from the container.

The rim of the container is normally in the form of an ellipse having an eccentricity of from 1.04 to 2 and preferably from 1.5 to 2.

The rim advantageously comprises a continuous fastening system, i.e., around its entire periphery.

To improve unlocking, unlocking slopes are provided on the neck at its intersection with the medians of the ellipse. Accordingly, there are four of these slopes.

They enable the bottom of the skirt of the closure to be deformed which facilitates unlocking.

To the same end, the two fastenings on the long side of the skirt are shorter than those on the wide side of the skirt.

The invention is described in more detail in the following with reference to the accompanying drawings, wherein:

DETAILED DESCRIPTION OF THE DRAWINGS

Figure 1:
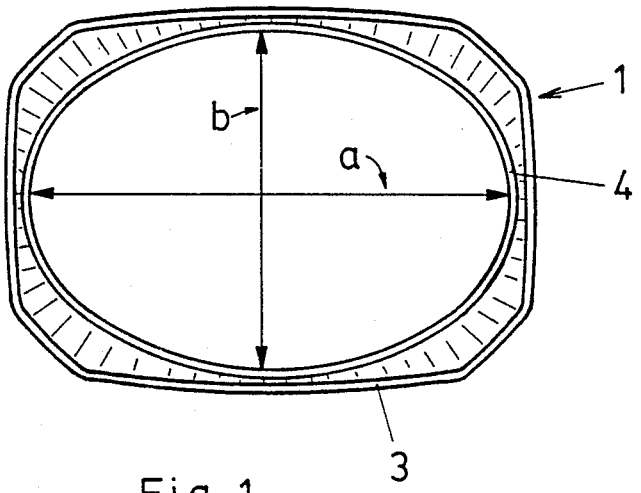
FIG. 1 is a plan view of the container.

The container (1), which is of substantially rectangular cross-section with rounded corners, comprises a base (2), side walls (3) and a neck (4). This neck is elliptical in shape and comprises a rim (5) for locking the closure, the rim forming the opening of the container. As shown in FIG. 1, and also in FIG. 5, the arrow associated with reference letter a depicts the major axis of the elliptical shape of the neck, rim and opening, and the arrow associated with reference letter b depicts the minor axis of the elliptical shape.

Figure 3:
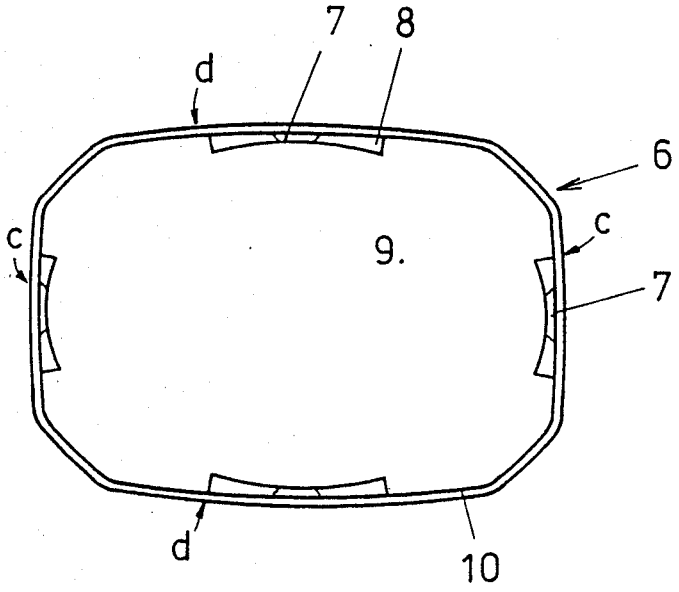
FIG. 3 is a view of the closure from beneath.

Referring to FIG. 3, the closure (6) is also of substantially rectangular cross-section and comprises a base (9), a deformable skirt (10), four fastening tabs (7) and tabs (8) for holding the insert (11) on the base of the closure, said tabs being on the inside of the skirt (10) which is adjacent the rim and neck. The insert is used to maintain a minimal flow of oxygen into the container. The substantially rectangular base, which extends to the deformable skirt sides of the closure delineates the width and length of the closure, the width being designated by reference letter c and the length being designated by reference letter d.

Figure 4:
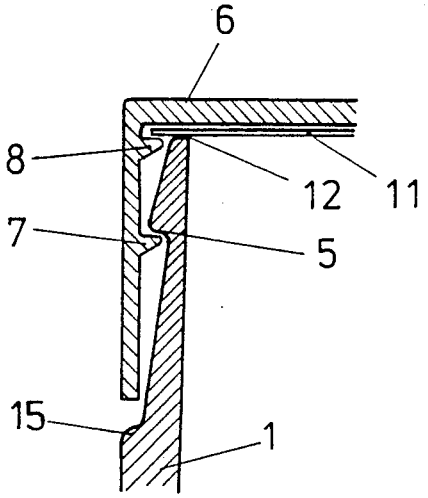
FIG. 4 is a partial section on the axis of the container and closure, the closure being in the fastened position.

In FIG. 4, the closure (6) is fastened to the container (1). The fastening tabs (7) are engaged on the rim (5) which has a continuous fastening system. The insert (11) held in place by the tabs (8) rests on the upper rim (12) of the neck. As illustrated, the closure skirt sides are substantially perpendicular to the closure base.

Figure 2:
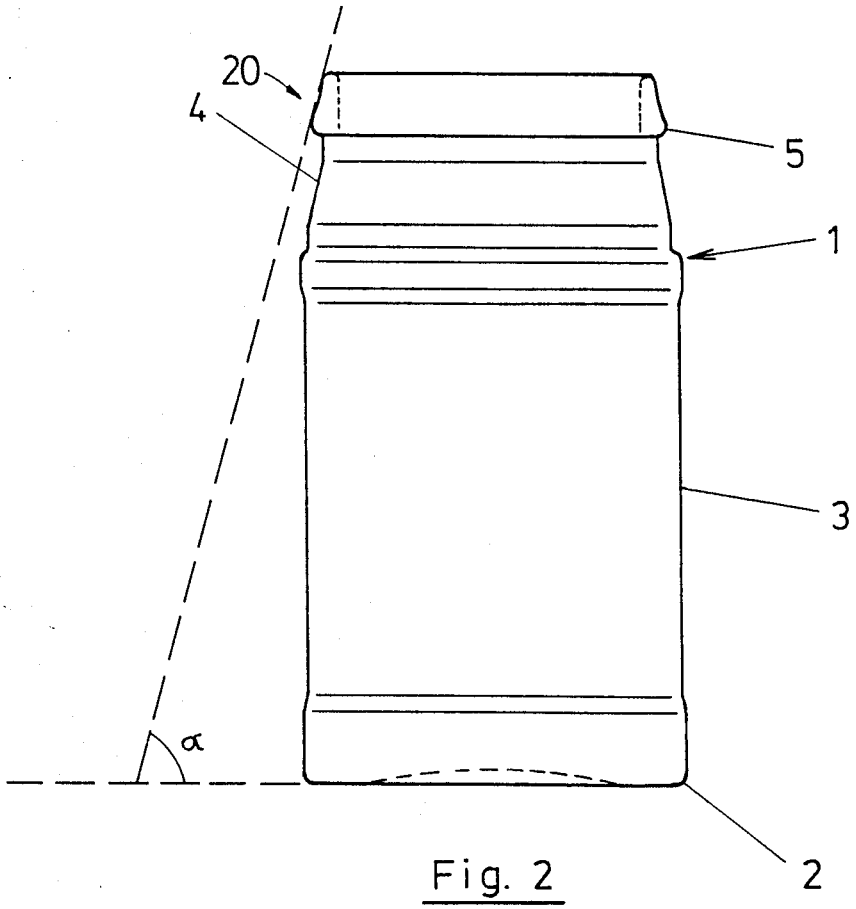
FIG. 2 is a lateral view of the container.

FIG. 2 also depicts an embodiment of the container wherein the rim (5) which surmounts neck (4) has an outer peripheral side portion (20) which forms an angle $\alpha$ with respect to a horizontal of the base (2) of between 60° and 75° which further facilitates unlocking.

Figure 5:
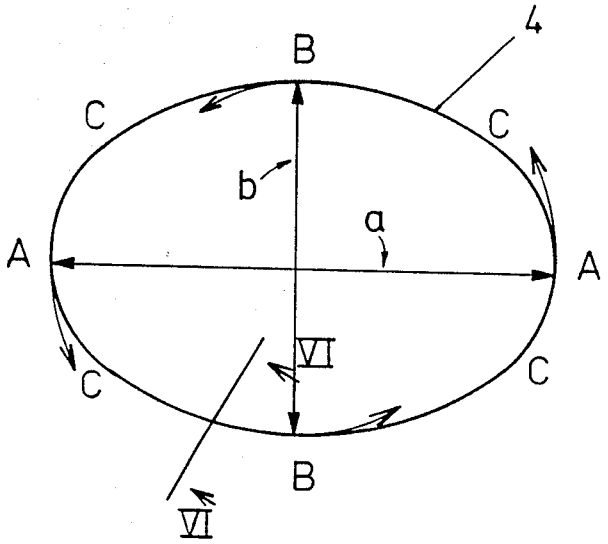
FIG. 5 diagrammatically illustrates the unlocking of the closure.

For unlocking, the closure is turned and FIG. 5 diagrammatically illustrates what happens. The arrows indicate the displacement of the fastening tabs. It can be seen that the elliptical rim of the container is an obstacle to this displacement. In position A of the fastening tabs, it can be seen that the elliptical configuration does not present any obstacle to their displacement. Accordingly, the skirt is not deformed in zone A. The tabs are released simply by the rotation of the closure. By contrast, the fastening tabs in zone B are unable to turn freely and abut against the elliptical rim. In this zone, the skirt is deformed until the fastening tabs are able to pass over the rim (5).

Figure 6:
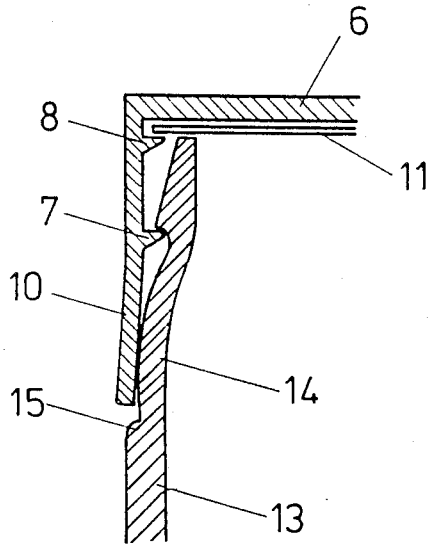
FIG. 6 is a partial section identical with FIG. 4 on the line VI—VI of FIG. 5 with a container comprising unlocking slopes.

In the embodiment shown in FIG. 6, the closure (6) has the same configuration as in FIG. 4 except that the container (13) has unlocking slopes in the zones C, zones positioned at the medians of the major and minor axes (FIG. 5). The bottom of the neck follows the contour of the shoulder (15) of the container which produces a slope variable by approximately 20° for the neck. The neck thus forms an angle of approximately 90° with the base of the container in zones A and B and an angle of approximately 70° in zone C. The bottom of the skirt (10) cooperates with the slope (14) when the closure (6) is turned. The skirt of the closure is thus deformed twice, namely at the slope (14) and at the elliptical rim (5). This further assists unlocking when the container is opened The fact that the container has an elliptical opening thus provides for a safe system and for easy release of the closure. In addition, this configuration is of considerable advantage in providing easier access for serving, for example instant coffee with a spoon.

We claim:

1. A container and closure comprising:

a container having a base connected to sidewalls extending to a container neck which is substantially elliptical in shape which is surmounted by a container rim which forms a substantially elliptical shape wherein the neck and rim define a container opening which is substantially elliptical in shape; and a closure for encompassing the container opening and rim having a substantially rectangular base which delineates a width and length of the closure, a deformable skirt forming sides of the closure which extends from the base along the width and the length of the base, and a fastening means which extends from a surface of each skirt closure side adjacent the rim and neck for engaging the rim for locking the closure to the rim so that upon rotation of the closure relative to the container, the fastening means extending from the skirt closure sides extending along the width of the base are disengaged from the rim while the fastening means extending from the skirt closure sides extending along the length of the base are unlocked and disengaged from the rim by means of deformation of the skirt closure sides of the length of the closure by the rim and neck of the container.

2. A container and closure according to claim 1 wherein the rim has an outer peripheral side portion which forms an angle with respect to a horizontal plane of the container base of from 60° to 75°.

3. A container and closure according to claim 1 or 2 wherein the elliptical shape formed by the rim has an eccentricity of from 1.04 to 2.

4. A container and closure according to claim 3 wherein the elliptical shape formed by the rim has eccentricity of from 1.5 to 2.

5. A container and closure according to claim 1 wherein each fastening means is positioned such that the fastening means are engaged at positions with the rim at zones corresponding with major and minor axes of the elliptical shape formed by the rim.

6. A container and closure according to claim 1 or 12 wherein the neck has a variable slope forming unlocking slopes at points corresponding to medians of major and minor axes of the elliptical shape of the rim.

7. A container and closure according to claim 1 wherein the rim extends completely about a periphery of the neck.

8. A container and closure according to claim 1 wherein the fastening means which extend from the skirt of the length sides of the base extend from the skirt for a distance less than a distance which the fastening means of the width sides extend from the skirt.

9. A container and closure according to claim 1 further comprising an insert fitted within the closure for covering the opening.

10. A container and closure according to claim 9 wherein the closure further comprises fastening tabs extending from the inner surface of the skirt for fastening the insert between the container and closure over the opening.

11. A container and closure according to claim 1 wherein the closure skirt sides are substantially perpendicular to the closure base.

* * * * *

UNITED STATES PATENT AND TRADEMARK OFFICE

CERTIFICATE OF CORRECTION

PATENT NO. : 4,967,921

DATED : November 6, 1990

INVENTOR(S) : Gerald Pre, et al.

It is certified that error appears in the above-identified patent and that said Letters Patent is hereby corrected as shown below:

Column 4, line 21 [line 1 of claim 6], "12" should be -- 5 --.

Signed and Sealed this

Tenth Day of March, 1992

*Attest:*

HARRY F. MANBECK, JR.

*Attesting Officer*

*Commissioner of Patents and Trademarks*